United States Patent [19]

Kington et al.

[11] Patent Number: 4,936,577

[45] Date of Patent: Jun. 26, 1990

[54] BASKETBALL TRAINING AND RETRIEVING ARRANGEMENT

[76] Inventors: Tristan N. Kington, 624 S. Morgan St., Morganfield, Ky. 42437; Billy D. Duncan, R. 2, Box 27, Sturgis, Ky. 42459

[21] Appl. No.: 245,506

[22] Filed: Sep. 19, 1988

[51] Int. Cl.[5] ..... A63B 63/08

[52] U.S. Cl. ..... 273/15 A

[58] Field of Search ..... 273/1.5 A, 395–397

[56] References Cited

U.S. PATENT DOCUMENTS

| | | | |
|---|---|---|---|
| 3,085,800 | 4/1963 | Holstad | 273/1.5 A |
| 3,776,550 | 12/1973 | McNabb | 273/1.5 A |
| 3,814,421 | 6/1974 | Spier, Jr. | 273/1.5 A |
| 3,901,506 | 8/1975 | Caveney | 273/1.5 A |
| 3,917,263 | 11/1975 | Wiley | 273/1.5 A |
| 4,291,885 | 9/1981 | Cohen | 273/1.5 A X |
| 4,667,957 | 5/1987 | Joseph | 273/1.5 A |
| 4,697,810 | 10/1987 | Mathison | 273/1.5 A |
| 4,786,371 | 11/1988 | Postol | 273/1.5 A |

*Primary Examiner*—Paul E. Shapiro

*Attorney, Agent, or Firm*—Warren D. Flackbert

[57] ABSTRACT

A basketball training and retrieving arrangement defined by an enlarged arch or ring mounted on a framework supported on a common basketball backboard and extending above and around an existing basketball goal. The invention plays importance in perfecting a player's ability, as from shooting at a three point line. Whether or not the basketball passes through the hoop of the goal, the basketball is introduced into a return which is selectively movable to the player's shooting location. The basketball return is rotatably mounted at a location below the basketball goal and includes a structural configuration which "kicks" the basketball into return movement along downwardly inclined rails.

2 Claims, 1 Drawing Sheet

BASKETBALL TRAINING AND RETRIEVING ARRANGEMENT

BACKGROUND OF THE INVENTION

As is known, the popularity of basketball is widespread. A need arises, however, for increasing each player's skill, as in connection with the three-point shooting circle. While various mechanical approaches have evolved to satisfy the preceding, such are mostly objectionable in installation and/or placement and, as well, in achieving effective basketball return irrespective of the player's location.

BRIEF DESCRIPTION OF THE PREFERRED EMBODIMENT

The basketball training and retrieving arrangement of the invention importantly provides for player skill improvement, where, at the outset, the instant arrangement is positively placed in a use condition directly on an existing basketball backboard, where the latter is available at every game and/or training site. The arrangement overlies and surrounds the existing hoop and serves to direct the moving basketball into a ball return which is pivotally movable with respect to the hoop, i.e. is accessible at the players particular location.

The arrangement of the invention is foldable, light in weight and portable, lending itself to readily transport, as from one training site to another or even to different basketball hoops at any given site.

A better understanding of the present invention will become more apparent from the following description, taken in conjunction with the accompanying drawing, wherein

Figures 1, 2, 3, 4, 5, 6:
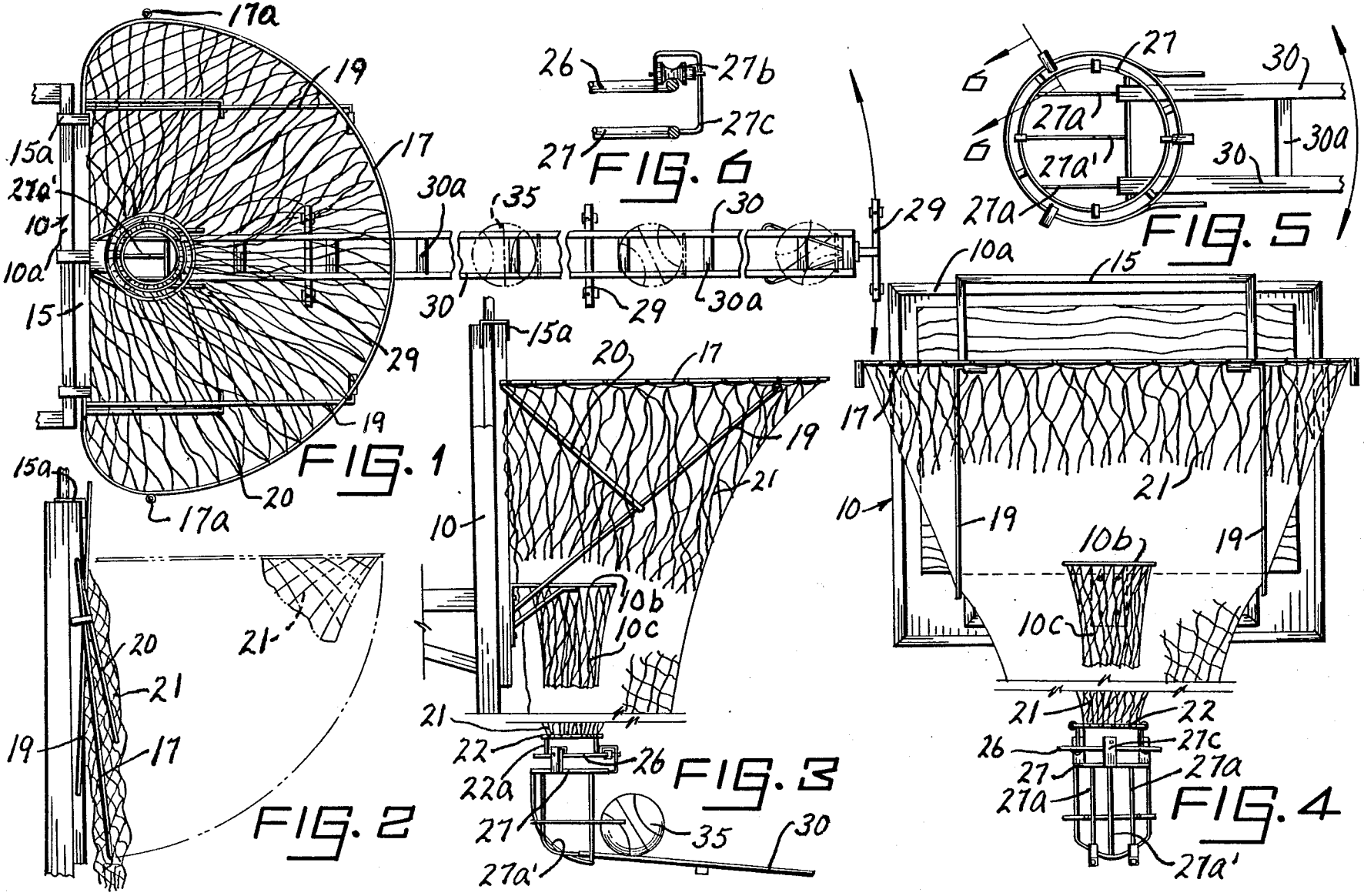
FIG. 1 is a top plan view of a basketball training and retrieving arrangement in accordance with the teachings of the present invention.
FIG. 2 is a view in side elevation showing the instant arrangement in a collapsed but installed condition.
FIG. 3 is a view in side elevation showing the arrangement in a use condition.
FIG. 4 is a view in front elevation of the arrangement showing such installed on a basketball backboard.
FIG. 5 is a top plan view, partly fragmentary, detailing the swivel arrangement for the basketball return; and, FIG. 6 is a view in vertical section, taken at line 6—6 and looking in the direction of the arrows, further detailing the swivel arrangement.

For the purposes of promoting an understanding of the principles of the invention, reference will now be made to the embodiment illustrated in the drawing and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now to the figures, the instant basketball training and retrieving arrangement is shown in connection with a common framework supported basketball backboard 10, the latter typically fabricated from fiberglass enclosed within a frame **10*a*, which supports a hoop 10*b* carrying a net 10*c***.

The arrangement of the invention includes a body or frame 15 (see FIG. 4) readily positioned on the backboard 10 (or in a use condition) by means of support brackets **15*a* (see FIGS. 1 and 3) secured onto the top thereof. Typically, the frame 15** may assume dimensions approximating 4 ft. wide and 5 ft. high.

The frame 15 pivotally mounts an upper ring member or arch 17, at approximately 12 feet above the playing surface, positioned by upwardly pivotal (from a collapsed position) and forwardly angling telescopic brace members 19 (see FIG. 4), also pivotally mounted on the frame 15, as well as associated pivotal downwardly angling steadying struts 20 (see FIG. 1).

In any event, the arrangement of the upper ring member 17, brace members 19 and steadying struts 20 permits ready conversion from a use position (FIG. 3), i.e. for practicing, to a non-use position (FIG. 2), i.e. for transporting and/or storage. The assembly is completed by the provision of netting 21 extending between the upper ring member 17 and a lower ring member 22.

As apparent, therefore, the preceding is accomplished by simple hanging action, where the upper ring member 17 is disposed above and around the conventional basketball goal. With the aid of the basketball return described below, the player can gain shooting expertise, as at various locations around the three point circle, and, at the same time, with basketball return available at each location.

In any event, the basketball return of the arrangement presented herein is most apparent in FIGS. 1, 3, 5 and 6, being connected, at its basketball feeding end, to lower ring member 22. Vertical segments **22*a* secure the lower ring member 22 to another ring member 26 which serves as a raceway for rollers 27*b* mounted, by segments 27*c*, onto still another ring member 27 (see FIG. 6**) which serves as part of the basketball return.

The latter further includes multi-vertical supports **27*a* which, by reason of a forwardly extending middle vertical support 27*a'*, serves to automatically feed (or "kick out") a basketball 35 along the overall return, i.e. prevents the basketball 35 from being halted, as would be the instance if each of the vertical supports 27*a*/27*a'*** would have the same shape or configuration.

The return, supported on a series of spaced apart wheel mounted frame members 29 and characterized by generally parallel downwardly inclined extended rails 30 having interconnecting members **30*a* therebetween, serves to move the basketball 35 along the ball return to the particular location of the player (and against a basketball stop which is multi-positionable along the rails 30). In other words, the basketball 35** is fed to a reuse location.

A feature of the preceding is, however, the ability to rotate the ring member 27 around the ring member 26, i.e. the basketball return moves throughout a range of 180°, as indicated by the directional arrow in FIGS. 1 and 5. Thus, the arrangement readily returns both the basketball shots which miss the hoop **10*b* as well as those which pass through the hoop 10*b***.

In other words, the instant arrangement is readily positioned by the mounting brackets **15*a* on a common basketball backboard 15; easily changed from a storage or transporting position (FIG. 2) to a use position (FIG. 3) by simple pivotal movement of the upper ring member 17, the brace members 19 and the steadying struts 20; poles (not shown) each having a pin-like projection at a free end which is adapted to be received in a loop 17***a* disposed on opposite sides of the upper ring member or arch 17 (see FIG. 1) serve for upper ring member 17 placement; and, where selective movement of the basketball return (to a location desired for practice) is accomplished through simple hand rotational action.

It should be evident, therefore, that the basketball training and retrieval arrangement of the invention does simplify both activities, i.e. serves to train and/or improve the player's shooting techniques, at different distance and, at the same time, serves for ready return of the basketball to the location of the player.

It should be remembered, however, that the above described arrangement is susceptible to various changes within the spirit of the invention, including, by way of example, in proportioning; the manner of securing the frame to an existing basketball backboard; the particular arrangement for achieving the collapsing of the arrangement for storage and/or transporting; specific details as to the basketball return; the manner of raising the upper ring member to a use condition; and, the like. Thus, the preceding should be considered illustrative and not as limiting the scope of the following claims:

We claim:

1. A basketball training and retrieving arrangement comprising, in combination with a basketball backboard supporting a net carrying hoop, framework selectively mounted on said backboard, an upper ring member mounted on said framework and extending above and outwardly from said hoop a distance permitting basketball passage in the event said hoop is mixed at a use condition, netting disposed on said upper ring member and extending downwardly to a lower ring member below said net carrying hoop having a smaller diameter than said upper ring member, and a basketball return communicating with said lower ring member and rotatable on structure mounted thereon to a variety of shooting locations at different distances, where means selectively pivot said upper ring member from a use position to a non-use position.

2. The basketball training and retrieving arrangement of claim 1 where said pivot means is defined as cooperable brace and strut members maintaining said upper ring member in a use condition.

* * * * *